US006624134B1

(12) United States Patent
Briatore et al.

(10) Patent No.: US 6,624,134 B1
(45) Date of Patent: Sep. 23, 2003

(54) PROCESS FOR STABILISATION OF COLOURED BLEACHING COMPOSITIONS

(75) Inventors: Andrea Briatore, Rome (IT); Oreste Todini, Castelnuovo di Porto (IT); Enza Ceccobelli, Genzzano (IT); Alessandro Gagliardini, Jesi (IT)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/148,762

(22) PCT Filed: Nov. 29, 2000

(86) PCT No.: PCT/US00/32550

§ 371 (c)(1),
(2), (4) Date: Oct. 24, 2002

(87) PCT Pub. No.: WO01/40424

PCT Pub. Date: Jun. 7, 2001

(30) Foreign Application Priority Data

Dec. 3, 1999 (EP) ..... 99870249

(51) Int. Cl.[7] ..... C11D 3/395
(52) U.S. Cl. ..... 510/419; 510/380
(58) Field of Search ..... 510/379, 419, 510/380

(56) References Cited

U.S. PATENT DOCUMENTS

| | | | | |
|---|---|---|---|---|
| 2,082,275 A | | 6/1937 | Daimler et al. | |
| 2,255,082 A | | 9/1941 | Orthner et al. | |
| 2,702,279 A | | 2/1955 | Funderburk et al. | |
| 3,586,715 A | | 6/1971 | Smeets et al. | |
| 3,699,059 A | | 10/1972 | Smeets | |
| 3,733,315 A | | 5/1973 | Smeets | |
| 3,742,029 A | | 6/1973 | Smeets | |
| 3,742,030 A | | 6/1973 | Smeets | |
| 3,929,678 A | | 12/1975 | Laughlin et al. | |
| 3,997,596 A | | 12/1976 | Smeets | |
| 4,271,030 A | | 6/1981 | Brierly et al. | |
| 4,623,476 A | | 11/1986 | Nayar et al. | |
| 4,708,816 A | | 11/1987 | Chang et al. | |
| 4,741,858 A | | 5/1988 | Choy et al. | |
| 5,139,695 A | * | 8/1992 | Eckhardt | 252/187.24 |
| 5,554,321 A | * | 9/1996 | Choy et al. | 510/398 |
| 5,750,321 A | * | 5/1998 | Texter et al. | 430/449 |

FOREIGN PATENT DOCUMENTS

| | | | |
|---|---|---|---|
| EP | 0 596 550 | * | 5/1994 |
| GB | 1082179 | | 5/1960 |
| JP | 5-320697 | * | 12/1993 |
| WO | WO 99/36497 A | | 7/1999 |

OTHER PUBLICATIONS

EP Application No. 98870247.8.

* cited by examiner

*Primary Examiner*—Yogendra N. Gupta
*Assistant Examiner*—John Petruncio
(74) *Attorney, Agent, or Firm*—James F. McBride; Kim W. Zerby; Steve W. Miller

(57) ABSTRACT

The present invention relates to a process for the stabilisation of an insoluble pigment in a hypohalite-containing composition and hypohalite-containing compositions comprising such stabilised pigment.

10 Claims, No Drawings

PROCESS FOR STABILISATION OF COLOURED BLEACHING COMPOSITIONS

CROSS REFERENCE TO RELATED APPLICATIONS

This Application claims the benefit of PCT International Application Ser. No. PCT/US00/0032550, filed Nov. 29, 2000, which in turn claims the benefit of of EP 99870249.2 filed Dec. 3, 1999.

FIELD OF THE INVENTION

The present invention relates to process of stabilising a pigment in a hypochlorite-containing bleaching composition. The present invention also relates to a hypochlorite-containing composition comprising an encapsulated pigment.

BACKGROUND OF THE INVENTION

Bleaching compositions are well-known in the art. Amongst the different bleaching compositions available, those relying on bleaching by hypohalite bleaches such as hypochlorite are often preferred, mainly for performance reasons.

An objective of the beach manufacturer is to achieve a bleach product that is stable, both chemically and physically over time, for example over periods of storage. This has been a constant challenge often owing to the aggressive nature of hypohalite bleaches.

Coloured bleaching compositions are particularly preferred often because the distinct appearance of the composition facilitates it's recognition by a consumer, thereby reducing potential misuse or consumption of a potentially irritant or even poisonous composition. However formulating a coloured bleaching composition can present a variety of stability related problems. The principal problems include, the settling of pigment to the bottom of the container and oxidation of dyes and pigments in the hypohalite bleach-containing bleaching composition.

It is the object of the present invention to provide a hypohalite-containing composition comprising a pigment and in which the pigment is chemically stable, even upon storage.

Thickened bleaching compositions are also preferred herein as the higher viscosity of the composition can aid suspension of the pigment. Thus, in a preferred embodiment of the invention, it is an objective to improve the physical stability of the pigment.

An advantage of the compositions according to the present invention is that in the pigment-containing bleaching compositions as described herein the pigment is chemically stable upon storage even in case said bleaching composition is formulated under alkaline conditions.

Another advantage of the compositions of the present invention is that they deliver effective bleaching performance, more particularly effective whiteness performance when used in any laundry application, as well as effective stain removal performance on various stains, even upon storage of the composition.

Advantageously the compositions of the invention are suitable for the bleaching of different types of surfaces including hard-surfaces like floors, walls, tills, glass, kitchen surfaces, bathrooms surfaces, toilet bowls and/or dishes and the like as well as fabrics. More particularly, the compositions of the present invention are suitable for bleaching any type of fabrics including natural fabrics (e.g., fabrics made of cotton, viscose, linen, silk and wool), synthetic fabrics such as those made of polymeric fibers of synthetic origin as well as those made of both natural and synthetic fibers.

A further advantage of the liquid bleaching compositions of the present invention is that said bleaching compositions are suitable for various laundry bleaching applications both when used in diluted conditions, e.g. as a detergent additive or a fully formulated laundry detergent composition, and when used in neat condition, e.g. as a liquid pretreater (spotter).

SUMMARY OF THE INVENTION

According to the present invention there is provided a process for stabilising an insoluble pigment in the presence of hypochlorite by combining the pigment with silica or a salt thereof. According to another aspect of the present invention the combination of pigment and silica or a salt thereof is present as a component of a hypochlorite-containing composition.

According to another aspect of the present invention there is provided a bleaching composition comprising hypochlorite and an insoluble pigment wherein the pigment is coated with silica.

DETAILED DESCRIPTION OF THE INVENTION

Process of Stabilisation

The present invention relates to a process of stabilising a pigment in the presence of hypochlorite and more preferably in a hypochlorite-containing bleaching composition. As is discussed above, bleaching compositions have from time to time in the past be designed to comprise a colouring agent, for example a pigment or dye. However selecting a colouring agent that could withstand the aggressive nature of the bleaching agent-containing bleaching composition and remain both chemically and physically stable over time has still proved problematic.

Colouring agents are available on the market that are specifically designed to be bleach and pH resistant. One of the most commonly used colouring agents having this characteristic is a pigment known as ultramarine blue. However the applicants have found that this pigment, although initially chemically stable to bleach, looses colour over time. The inability of the pigment to withstand chemical deterioration, for example via oxidation by the bleach and/or via chemical degradation due to the alkalinity, when present, of the bleaching composition, over time is believed to be due to the disruption of the structure of the pigment.

The Applicants have found that stabilisation is achieved by combining the pigment with silica or a salt thereof, and hence loss of colour through chemical instability can be decreased.

Furthermore, it has been observed that when a bleaching composition is formulated at an alkaline pH, the problem of the chemical instability of pigments is further increased due to the chemical degradation of the pigments by the alkalinity of the bleaching composition. The Applicants have now found that stabilisation is achieved by combining the pigment with silica or a salt thereof, in a bleaching composition preferably formulated at an alkaline pH, more preferably at a pH of from 10 to 14, and most preferably at a pH of from 12 to 14, and hence loss of colour through chemical instability can be decreased.

By "chemically stable", it is meant that the hypochlorite in the compositions of the present invention does not undergo more than 25% loss of available chlorine after 5 days of storage at 50° C. ±0.5° C., preferably not more than 20%. The % loss of available chlorine may be measured using the method described, for instance, in "Analyses des Eaux et Extraits de Javel" by "La chambre syndicate nationale de L'eau de Javel et des produits connexes", pages 9–10 (1984). Said method consists in measuring the available chlorine in the fresh compositions, i.e. just after they are made, and in the same compositions after 5 days at 50° C.

By "chemically stable", it is also meant that the pigment is stable to hypohalite bleach as determined according to the following test method:

Given K is the % of pigment in the composition, prepare the following 6 standards, agitating continually until comparison.

| | |
|---|---|
| 0 | Distilled water |
| 1 | 0.2 × K % Pigment + Balance Water |
| 2 | 0.4 × K % Pigment + Balance Water |
| 3 | 0.6 × K % Pigment + Balance Water |
| 4 | 0.8 × K % Pigment + Balance Water |
| 5 | K % Pigment + Balance Water |

The hypochlorite composition comprising pigment and silica or salt thereof in study is prepared and stored for 10 days at 40° C. and then stirred. The composition is then compared with the 6 reference samples as described above. Four expert panelists will grade the color intensity of the hypochlorite composition by comparison of the colour intensity of the composition with the 6 reference samples (above) assigning to the composition a color intensity grade equal to the number of the standard sample which is most similar. If the average color intensity grade is equal or higher than 1 then the pigment is stable to hypohalite. More preferably, the average color intensity grade is higher than 2 and even more preferably higher than 3.

Hypohalite Bleach

An essential component of the invention is a hypohalite bleach. Hypohalite bleaches may be provided by a variety of sources, including bleaches that are oxidative bleaches and subsequently lead to the formation of positive halide ions as well as bleaches that are organic based sources of halides such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins.

For the liquid compositions herein, the preferred hypohalite bleaches among the above described are the alkali metal and/or alkaline earth metal hypochlorites selected from the group consisting of sodium, potassium, magnesium, lithium and calcium hypochlorites, and mixtures thereof, more preferably the alkali metal sodium hypochlorite.

Preferably, the liquid compositions according to the present invention comprise said hypohalite bleach or mixture thereof such that the content of active halide in the composition is from 0.1% to 20% by weight, more preferably from 0.25% to 8% by weight, most preferably from 0.5% to 6% by weight of the composition.

Pigment

The process of the present invention involves the stabilisation of a substantially water insoluble pigment. Such pigments are preferably selected from the Ultramarine class of pigments. is another essential component for the coloured thickened compositions of the present invention. The Ultramarine class of pigments include polysulfide, polytellurium and polyseleniums of aluminosilicate compounds in which the counterion is selected from sodium, potassium, lithium and silver. Such pigments reflect a number of different colours for example blue, green, red, violet and pink.

The most preferred pigments are those of the class known as Ultramarine Blue. Ultramarine Blue as listed in the colour index as "C.I. Pigment Blue 29; C.I. 77007" and is a blue pigment occurring naturally as the mineral lapis lazulli. It is made by igniting a mixture of kaolin, $Na_2CO_3$ (or $Na_2SO_4$), S and carbon and believed to have the general formula $Na_7Al_6Si_6O_{24}S_2$.

Ultramarine blue pigments are available as insoluble particles. Preferred pigments have average particle size of less than 5 microns, more preferably less than 4 microns, even more preferably less than 3 microns and most preferably between 1 and 3 microns.

In order to stably suspend the pigment over long periods of storage it is preferred according to the present invention to incorporate a thickening system into the hypochlorite-containing composition. In this way even pigment particles having density greater than the hypochlorite-containing composition can be stably suspended.

The pigment or a mixture thereof is present in the compositions of the present invention at levels of from 0.0001% to 0.5%, preferably from 0.0002% to 0.1%, more preferably from 0.003% to 0.1% and most preferably from 0.006% to 0.05%.

Silica and Salt Thereof

The pigments of the present invention are stabilised from chemical attach by hypochorite bleach by combining them with silica or a salt thereof. The Applicants have found that such stabilisation can be achieved by any of at least three alternative approaches. The first approach is coating the pigment with silica. Such coating is achieved industrially by the silica coated manufacturers. Silica coated ultramarine blue pigment can be commercially obtained from Hollyday Pigments under the tradename Ultramarine Blue 54 and Ultramarine Blue 17.

Alternatively, the pigment can be combined with a liquid silica salt (or silicate)-containing composition to form a pigment/silica salt premix. This premix is then combined with the hypochlorite-containing composition. The weight ratio of silicate to pigment in the premix is at least 0.5:1, more preferably at least 0.75:1, most preferably greater than 1:1 silicate expressed as SiO2).

In a third approach, the silica salt and pigment can be directly combined with the hypochlorite-containing composition without forming a premix. Where this third approach is used the silicate is preferably present in the hypochlorite-containing composition at a level of at least 50 ppm, more preferably greater than 100 ppm, even more preferably greater than 200 ppm. Pigment is added to the composition at a level as defined above. The ratio of silicate to pigment in this third embodiment is again preferably at least 0.5:1, more preferably 0.75:1, most preferably greater than 1:1 (silicate expressed as SiO2).

Bleaching Compositions

Where the process of the present invention involves a bleaching composition, the composition may be in any form, but are preferably in liquid form. Preferably, the compositions of the invention are in liquid aqueous form. More preferably, they comprise water in an amount of from 60% to 98% by weight, more preferably of from 80% to 97% and most preferably of from 85% to 97% by weight of the total aqueous liquid bleaching composition.

In a particularly preferred embodiment of the present invention, the composition is thickened. More preferably the composition is thickened to a viscosity of from 10 cps to 2000 cps, more preferably from 20 cps to 1500 cps, and most preferably from 25 cps to 1000 cps. Viscosity according to the present invention is measured using a Carri-med CSL2-100® rheometer, at the following viscosity parameters: angle 158', gap 60 $\mu$m, diameter 4.0 cm, inner 63.60 dyne*cm*s$2^2$, temperature of 25 C. and a shear rate of 30 sec−1.

Any known thickening system can be used for the purposes as required herein. Examples of such thickening systems include those based on polymers, in particular polycarboxylic polymers and even more in particular cross linked polyacrylates such as those marketed by BF Goodrich under the tradename Carbopol. A preferred thickening system comprises an alkyloxylated sulfate or alkyl sulfate surfactant or mixtures thereof, preferably having an alkyl chain of greater than 12 carbon atoms, more preferably from 14 to 20 carbon atoms and most preferably from 14 to 16 carbon atoms.

An alternative and particularly preferred thickening system comprises a combination of an amphoteric and/or zwitterionic surfactant and a counterion. Preferred surfactants for use therein are selected from the group consisting of amine oxide, betaine, sulphobetaines and mixtures thereof as described in more detail below. Preferred surfactants of the thickening system comprise at least one hydrocarbon chain having 12 to 18 carbon atoms. The most preferred surfactants for use as an ingredient of this thickening system are hexadecyl dimethyl amine oxide and hexadecyl betaine. The counterion of the thickening system is preferably selected from the group consisting of aryl and $C_{2-6}$ carboxylates, aryl and $C_{2-6}$ sulphonates, sulfated aryl alcohols and mixtures thereof. Aryl compounds may be preferably based on benzene or naphthalene compounds and may be substituted. Preferred substituents include alkyl or alkoxy groups of 1–4 carbons, halogens and nitro groups. The counterions may be added in their acid forms and then converted to the salt form in situ or may be directly used in the salt form. Where present the substituent may be located at any position on the ring structure of benzene or naphthalene. However positions 3 and 4 of the benzene ring are preferred. Preferred counterions are sulphonates and more preferably are selected from the group consisting of cumene, toluene, xylene sulphonate and mixtures thereof. The weight ratio of surfactant to counterion is preferably between 4:1 to 1:2, more preferably between 3:1 to 1:2 and most preferably 2:1. The thickening system is added to the hypochlorite-containing composition is sufficient quantities in order to achieve the desired viscosity. In a preferred embodiment the thickening system is added to the composition at a level of from 0.1% to 2.5%, more preferably from 0.2% to 1% and most preferably from 0.2% to 0.5% by weight of the composition.

By "physically stable", it is meant that no visually noticeable pigment settling occurs after 1 month storage at 25° C.

Surfactants

The compositions of the present invention may in an especially preferred aspect, further comprise a surfactant or a mixture thereof as a desirable optional ingredient to provide cleaning and regulate the viscosity of the compositions herein as a thickening system or a component thereof.

Typically, where the compositions according to the present invention comprise surfactant, it is present in amounts of from 0.01% to 10% by weight of the total composition, preferably of from 0.05% to 5% and more preferably of from 0.05% to 1%. Where present the surfactant may be selected from anionic, nonionic, zwitterionic, amphoteric and mixtures thereof. In a more preferred embodiment of the present invention the surfactant is selected from amphoteric, zwitterionic surfactants and mixtures thereof. In an even more preferred embodiment of the present invention, the surfactant is selected from amine oxide, betaine, sulphobetaine and mixtures thereof.

Suitable anionic surfactants for use herein include alkyl sulphates. Suitable alkyl sulphates for use herein include water-soluble salts or acids of the formula $ROSO_3M$ wherein R is a $C_6$–$C_{24}$ linear or branched, saturated or unsaturated alkyl group, preferably a $C_8$–$C_{20}$ alkyl group, more preferably a $C_8$–C16 alkyl group and most preferably a $C_{10}$–C14 alkyl group, and M is H or a cation or ammonium or substituted ammonium. As discussed above, where the surfactant is used as a means of thickening the composition, preferred alkyl sulphates include those having an alkyl chain length of greater than 10 carbon atoms, more preferably from 12 to 20 carbon atoms and most preferably from 12 to 18 carbon atoms. Examples of preferred sulphate surfactants include sodium dodecyl sulphate, sodium tetradecyl sulphate, sodium hexadecyl sulphate.

Suitable anionic surfactants for use herein further include alkoxylated sulphate surfactants. Suitable alkoxylated sulphate surfactants for use herein are according to the formula $RO(A)_mSO_3M$ wherein R is an unsubstituted $C_6$–$C_{24}$ alkyl, hydroxyalkyl or alkyl aryl group, having a linear or branched $C_6$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy or butoxy unit or a mixture thereof, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphates, alkyl butoxylated sulphates as well as alkyl propoxylated sulphates are contemplated herein. Exemplary surfactants are $C_{12}$–$C_{18}$ alkyl polyethoxylate (1.0) sulphate ($C_{12}$–$C_{18}$E(1.0)SM), $C_{12}$–$C_{18}$ alkyl polyethoxylate (2.25) sulphate ($C_{12}$–$C_{18}$E(2.25)SM), $C_{12}$–$C_{18}$ alkyl polyethoxylate (3.0) sulphate ($C_{12}$–$C_{18}$E(3.0)SM), and $C_{12}$–$C_{18}$ alkyl polyethoxylate (4.0) sulphate ($C_{12}$–$C_{18}$E(4.0)SM), wherein M is conveniently selected from sodium and potassium. As discussed above, where the surfactant is used as a means of thickening the composition, preferred alkoxylated sulphates include those having an alkyl chain length of greater than 12 carbon atoms, more preferably from 14 to 20 carbon atoms and most preferably from 14 to 16 carbon atoms and from 1 to 20 moles of alkoxy groups, more preferably from 1 to 5 alkoxy groups, more preferably ethoxy groups. Suitable ethoxy sulphate surfactants include sodium dodecyl ethoxy sulphate (ethoxylation degree around 3), sodium tetradecyl ethoxy sulphate (ethoxylation degree around 3), sodium hexadecyl ethoxy sulphate (ethoxylation degree around 4).

Suitable anionic surfactants for use herein further include alkyl aryl sulphates. Suitable alkyl aryl sulphates for use herein include water-soluble salts or acids of the formula $ROSO_3M$ wherein R is an aryl, preferably a benzyl, substituted by a $C_6$–$C_{24}$ linear or branched saturated or unsaturated alkyl group, preferably a $C_8$–C20 alkyl group and more preferably a $C_{10}$–$C_{16}$ alkyl group and M is H or a cation, or ammonium or substituted ammonium.

Suitable anionic surfactants for use herein further include alkyl sulphonates. Suitable alkyl sulphonates for use herein include water-soluble salts or acids of the formula $RSO_3M$ wherein R is a $C_6$–$C_{20}$ linear or branched, saturated or unsaturated alkyl group, preferably a $C_8$–$C_{18}$ alkyl group and more preferably a $C_{14}$–$C_{17}$ alkyl group, and M is H or a cation, e.g., an alkali metal cation or ammonium or substituted ammonium.

Suitable anionic surfactants for use herein further include alkyl aryl sulphonates. Suitable alkyl aryl sulphonates for use herein include water-soluble salts or acids of the formula $RSO_3M$ wherein R is an aryl, preferably a benzyl, substituted by a $C_6$–$C_{20}$ linear or branched saturated or unsaturated alkyl group, preferably a $C_8$–$C_{18}$ alkyl group and more preferably a $C_9$–$C_{14}$ alkyl group, and M is H or a cation, or ammonium or substituted ammonium.

Suitable anionic surfactants for use herein further include alkoxylated sulphonate surfactants. Suitable alkoxylated sulphonate surfactants for use herein are according to the formula $R(A)_mSO_3M$ wherein R is an unsubstituted $C_6$–$C_{20}$ alkyl, hydroxyalkyl or alkyl aryl group, having a linear or branched $C_6$–$C_{20}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy or butoxy unit, m is greater than zero, typically between 0.5 and 6, more preferably between 0.5 and 3, and M is H or a cation, ammonium or substituted-ammonium cation. Alkyl ethoxylated sulphonates, alkyl butoxylated sulphonates as well as alkyl propoxylated sulphonates are contemplated herein.

Suitable anionic surfactants for use herein further include $C_6$–$C_{20}$ alkyl alkoxylated linear or branched diphenyl oxide disulphonate surfactants. Suitable $C_6$–$C_{20}$ alkyl alkoxylated linear or branched diphenyl oxide disulphonate surfactants for use herein are according to the following formula:

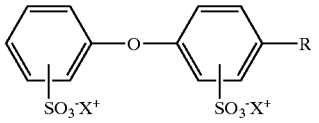

wherein R is a $C_6$–$C_{20}$ linear or branched, saturated or unsaturated alkyl group, preferably a $C_6$–$C_{18}$ alkyl group and more preferably a $C_6$–$C_{14}$ alkyl group, and X+ is H or a cation, Other suitable anionic surfactants for use herein include alkyl-carboxylates. Other anionic surfactants can include salts (including, for example, sodium, potassium, ammonium, and substituted ammonium salts such as mono-, di- and triethanolamine salts) of soap, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Suitable nonionic surfactants for use herein are fatty alcohol ethoxylates and/or propoxylates which are commercially available with a variety of fatty alcohol chain lengths and a variety of ethoxylation degrees. Indeed, the HLB values of such alkoxylated nonionic surfactants depend essentially on the chain length of the fatty alcohol, the nature of the alkoxylation and the degree of alkoxylation. Surfactant catalogues are available which list a number of surfactants, including nonionics, together with their respective HLB values. The preferred nonionic surfactants are capped i.e. those where, instead of an H at the end of the chain there is an R group, preferably a methyl group. Such surfactants are for example marketed by BASF in the Plurafac range, for example Plurafac LF231.

Suitable amphoteric surfactants for use herein include amine oxides having the following formula $R_1R_2R_3NO$ wherein each of R1, R2 and R3 is independently a saturated substituted or unsubstituted, linear or branched hydrocarbon chains of from 1 to 30 carbon atoms. Preferred amine oxide surfactants to be used according to the present invention are amine oxides having the following formula $R_1R_2R_3NO$ wherein R1 is an hydrocarbon chain comprising from 1 to 30 carbon atoms, preferably from 6 to 20, more preferably from 12 to 18, even more preferably from 14 to 16, and wherein R2 and R3 are independently substituted or unsubstituted, linear or branched hydrocarbon chains comprising from 1 to 4 carbon atoms, preferably from 1 to 3 carbon atoms, and most preferably are methyl groups. R1 may be a saturated substituted or unsubstituted linear or branched hydrocarbon chain. R1 is most preferably C16 alkyl group. Such amine oxides are commercially available from Hoechst and Clariant.

Suitable zwitterionic surfactants for use herein contain both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used. A generic formula for some zwitterionic surfactants to be used herein is $$R_1—N^+(R_2)(R_3)R_4X^-$$

wherein $R_1$ is a hydrophobic group; $R_2$ and $R_3$ are each $C_1$–$C_4$ alkyl, hydroxy alkyl or other substituted alkyl group which can also be joined to form ring structures with the N; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is preferably a carboxylate or sulfonate group. Preferred hydrophobic groups $R_1$ are alkyl groups containing from 1 to 24, preferably from 12 to 18, more preferably 14 to 16 carbon atoms. The hydrophobic group can contain instauration and/or substituents and/or linking groups such as aryl groups, amido groups, ester groups and the like. In general, the simple alkyl groups are preferred for cost and stability reasons.

Highly preferred zwitterionic surfactants include betaine and sulphobetaine surfactants, functionalized betaines such as acyl betaines, alkyl imidazoline alanine betaines, glycine betaines, derivatives thereof and mixtures thereof. Said betaine or sulphobetaine surfactants are preferred herein as they help disinfection by increasing the permeability of the bacterial cell wall, thus allowing other active ingredients to enter the cell.

Suitable betaine and sulphobetaine surfactants for use herein are the betaine/sulphobetaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference. Preferred betaine and sulphobetaine surfactants herein are according to the formula

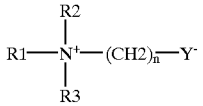

wherein R1 is a hydrocarbon chain containing from 1 to 24 carbon atoms, preferably from 12 to 18, more preferably from 14 to 16, wherein R2 and R3 are hydrocarbon chains containing from 1 to 3 carbon atoms, preferably 1 carbon atom, wherein n is an integer from 1 to 10, preferably from 1 to 6, more preferably is 1, Y is selected from the group consisting of carboxyl and sulfonyl radicals and wherein the sum of R1, R2 and R3 hydrocarbon chains is from 14 to 24 carbon atoms, or mixtures thereof.

Examples of particularly suitable betaine surfactants include C12–C18 alkyl dimethyl betaine such as coconutbetaine and C10–C16 alkyl dimethyl betaine such as laurylbetaine. Coconutbetaine is commercially available from Seppic under the trade name of Amonyl 265®. Laurylbetaine is commercially available from Albright & Wilson under the trade name Empigen BB/L®.

Other specific zwitterionic surfactants have the generic formulas:

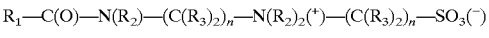

or

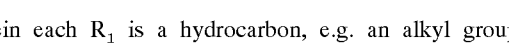

wherein each $R_1$ is a hydrocarbon, e.g. an alkyl group containing from 8 up to 20, preferably up to 18, more preferably up to 16 carbon atoms, each $R_2$ is either a hydrogen (when attached to the amido nitrogen), short chain alkyl or substituted alkyl containing from one to 4 carbon atoms, preferably groups selected from the group consisting of methyl, ethyl, propyl, hydroxy substituted ethyl or propyl and mixtures thereof, preferably methyl, each $R_3$ is selected from the group consisting of hydrogen and hydroxy groups and each n is a number from 1 to 4, preferably from 2 to 3, more preferably 3, with no more than one hydroxy group in any $(C(R_3)_2)$ moiety. The $R_1$ groups can be branched and/or unsaturated. The $R_2$ groups can also be connected to form ring structures. A surfactant of this type is a $C_{10}$–$C_{14}$ fatty acylamidopropylene(hydroxypropylene)sulfobetaine that is available from the Sherex Company under the trade name "Varion CAS sulfobetaine"®.

pH

The pH of the liquid compositions according to the present invention, as is, is typically from 10 to 14, more preferably from 12 to 14 measured at 25° C. The liquid compositions of the invention have a pH of from 7.5 to 13, preferably from 8 to 12, more preferably from 8.5 to 11.5, when diluted into 1 to 500 times its weight of water. It is in this alkaline range that the optimum stability and performance of the hypohalite as well as fabric whiteness and/or safety are obtained. The pH range is suitably provided by the hypohalite bleach mentioned hereinbefore, which are alkalis and optionally by the pH buffering component if present. However, in addition to these components, a strong source of alkalinity may also optionally be used.

Suitable sources of alkalinity are the caustic alkalis such as sodium hydroxide, potassium hydroxide and/or lithium hydroxide, and/or the alkali metal oxides such as sodium and/or potassium oxide. A preferred strong source of alkalinity is a caustic alkali, more preferably sodium hydroxide and/or potassium hydroxide. Typical levels of such caustic alkalis, when present, are of from 0.1% to 1.5% by weight, preferably from 0.5% to 1.5% by weight of the composition.

The composition according to the invention may comprise other optional components such as pH buffering components, stabilizing agents, other bleach-stable surfactants, builders, thickening agents, polymers, dyes, solvents, perfumes, brighteners, and mixtures thereof.

Optional pH Buffering Components

The compositions according to the present invention may optionally comprise a pH buffering component or mixture thereof. Such a pH buffering component is a highly preferred optional ingredient for the compositions of the invention.

The pH buffering component ensures that the pH of the composition is buffered to a pH value ranging from 7.5 to 13, preferably from 8 to 12, more preferably from 8.5 to 11.5 after the composition has been diluted into 1 to 500 times its weight of water.

Suitable pH buffering components for use herein are selected from the group consisting of alkali metal salts of carbonates, polycarbonates, sesquicarbonates, silicates, polysilicates, boron salts, phosphates, stannates, alluminates and mixtures thereof. The preferred alkali metal salts for use herein are sodium and potassium.

Suitable boron salts or mixtures thereof for use herein include alkali metal salts of borates and alkyl borates and mixtures thereof. Examples of boron salts include boric acid, alkali metal salts of metaborate, tetraborate, octoborate, pentaborate, dodecaboron, borontrifluoride and alkyl borate containing from 1 to 12 carbon atoms, preferably from 1 to 4. Suitable alkyl borate includes methyl borate, ethyl borate and propyl borate. Particularly preferred boron salts herein are the alkali metal salts of metaborate, such as sodium metaborate, potassium metaborate, and the alkali metal salts of borate, such as sodium borate, or mixtures thereof. Boron salts like sodium metaborate and sodium tetraborate are commercially available from Borax and Societa Chimica Larderello under the name sodium metaborate and Borax®.

Particularly preferred pH buffering components are selected from the group consisting of sodium carbonate, sodium silicate, sodium borate, sodium metaborate and mixtures thereof.

The raw materials involved in the preparation of hypohalite bleaches usually contain by-products, e.g. calcium carbonate resulting in an amount of up to 0.4% by weight of by-product within the hypohalite composition. However, at such amount, the by-product will not have the buffering action defined above.

Liquid bleaching compositions herein preferably contain an amount of pH buffering component of from 0.5% to 9% by weight, preferably from 0.5% to 5% by weight, and more preferably in an amount of from 0.6% to 3% by weight of the composition.

The presence of such a pH buffering component in the bleaching compositions of the present invention contributes to the effective whiteness performance of said compositions as well as to the fabric safety of these compositions.

Radical Scavenger

Suitable radical scavengers for use herein include aromatic radical scavengers comprising an unsaturated ring system of from 3 to 20 carbon atoms, preferably of from 3 to 18 and more preferably of from 5 to 14 and having a double bond set comprising a total of 4n+2 electrons, wherein n is an integer of from 0 to 4, preferably of from 1 to 3. Indeed said aromatic radical scavengers include benzene derivatives, naphthalene derivatives, annulene derivatives, cyclopentadiene derivatives, cyclopropene derivatives and the like, especially aryl carboxylates and/or aryl sulfonates.

Particularly suitable radical scavengers (aryl carboxylates, aryl sulphonate and derivatives thereof) for use in the present invention have one of the following formulas:

(a)

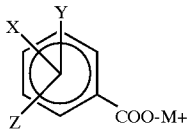

(b)

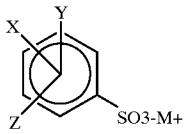

c)

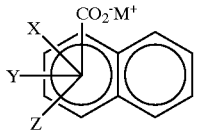

d)

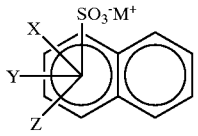

wherein each X, Y, and Z are —H, —COO—$M^+$, —Cl, —Br, —$SO_3$—$M^+$, —$NO_2$, —$OCH_3$, or a $C_1$ to $C_{10}$ primary and secondary alkyl groups and M is H or an alkali metal, or mixtures thereof. Examples of these components include pyromellitic acid, i.e. where X, Y and Z are —COO—$H^+$; hemimellitic acid, trimellitic acid, i.e. where X and Y are —COO—$H^+$ and Z is H. Preferred to be used in the present invention as radical scavengers are phthalic acid; sulfophthalic acid; other mono-substituted phthalic acids; di-substituted benzoic acids; alkyl-, chloro-, bromo-, sulfo-, nitro- and alkoxybenzoic acids, i.e. where Y and Z are —H and X is a $C_1$ to $C_{10}$ primary and secondary alkyl groups, —Cl, —Br, —$SO_3$—$H^+$, —$NO_2$ or —$OCH_3$ (anisic acid) respectively and substituted sulfonic acids. Highly preferred examples of the radical scavengers useful in the present invention are benzoic acid, toluic acid, 4-toluene sulfonic acid, 3-nitro benzoic acid, 2 n-octyl benzoic acid, 2 n-octyl sulfonic acid, anisic acid or mixtures thereof. Most preferred herein, mono and poly methoxy benzoic acids.

Also preferred are radical scavengers of the above general formulae having instead of 1, 2 or 3 substituent groups, having 4, 5, or 6 substituents, where possible. Also included within the set of preferred radical scavengers are those where the above structures are present in polymeric form. These compounds are described in more detail in the Applicants co-pending European patent application number 98870247.8.

All the radical scavengers described above are the acidic form of the species, i.e. M is H. It is intended that the present invention also covers the salt derivatives of these species, i.e. M is an alkali metal, preferably sodium or potassium. In fact, since the pH of the compositions of the present invention is in the alkaline range, the radical scavengers of the present invention exist primarily as the ionized salt in the aqueous composition herein. The anhydrous derivatives of certain species described herein above can also be used in the present invention, e.g. pyromellitic dianhydride, phthalic anhydride, sulphthalic anhydride and the like.

Typically, the compositions according to the present invention may comprise from 0.01% to 10% by weight of the total composition of a radical scavenger, or mixtures thereof, preferably from 0.01% to 8% by weight, more preferably from 0.1% to 5%, and most preferably from 0.2% to 3%.

Brighteners

The compositions according to the present invention may optionally also comprise a brightener or a mixture thereof as an optional ingredient. Naturally, for the purpose of the invention, the brightener has to be stable to the hypohalite bleach. The brighteners may be desired herein to further enhance the whiteness performance of the compositions herein.

Brighteners are compounds which have the ability to fluorescent by absorbing ultraviolet wave-lengths of light and re-emitting visible light. Brighteners, also referred to as fluorescent whitening agent (FWA), have been extensively described in the art, see for instance EP-A-0 265 041, EP-A-0 322 564, EP-A-0 317 979 or "Fluorescent whitening agents" by A. K. Sarkar, published by MERROW, especially page 71–72.

Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982). Further optical brighteners which may also be used in the present invention include naphthlimide, benzoxazole, benzofuran, benzimidazole and any mixtures thereof.

Examples of optical brighteners which are useful in the present compositions are those identified in U.S. Pat. No. 4,790,856. These brighteners include the PHORWHITE® series of brighteners from Verona. Other brighteners disclosed in this reference include: Tinopal-UNPA®, Tinopal CBS® and Tinopal 5BM® available from Ciba-Geigy; Artic White CC® and Artic White CWD®; the 2-(4-styryl-phenyl)-2H-naptho[1,2-d]triazoles; 4,4'-bis(1,2,3-triazol-2-yl)-stilbenes; 4,4'-bis(styryl)bisphenyls; and the aminocoumarins.

Specific examples of brighteners useful herein include 4-methyl-7-diethyl-amino coumarin; 1,2-bis(-benzimidazol-2-yl)ethylene; 1,3-diphenyl-pyrazolines; 2,5-bis (benzoxazol-2-yl)thiophene; 2-styryl-naptho-[1,2-d] oxazole; 2-(stilbene4-yl)-2H-naphtho[1,2-d]triazole, 3-phenyl-7-(isoindolinyl)coumarin; 3-methyl-7-(isoindolinyl)coumarin; 3-chloro-7-(isoindolinyl)coumarin; 4-(isoindolinyl)-4-methylstilbene; 4-(isoindolinyl)-4'-methoxystilbene; sodium 4-(isoindolinyl)-4-stilbenesulfonate; 4-(isoindolinyl4'-phenylstilbene; 4-(isoindolinyl)-3-methoxy-4'-methylstilbene; 4-(2-chloroisoindolinyl)-4'-(2-methylisoindolinyl)-2,2-stilbenedisosulfonic acid; disodium 4,4'-diisoindolinyl-2,2-stilbene disulfonate; 4,4'-diisoindolinyl-2,2-stilbenedisulfonamide; disodium 4,4'-(7,8-dichloro-1-isoindolinyl)2,2-stilbenedisulfonate; disodium 4,4'-(7-chloro-1-isoindolinyl)2,2-stilbenedisulfonate; disodium 4,4'-(6-lsopropoxy-1-isoindolinyl)2,2-stilbenedisulfonate; disodium 4,4'-(7,8-diisopropyl-1-isoindolinyl)2,2-stilbenedisulfonate; disodium 4,4'-(7-butoxy-1-isoindolinyl) 2,2-stilbenedisulfonate; disodium 4,4'-(6-trifluoromethyl-1-isoindolinyl)2,2-stilbenedisulfonate; disodium 4,4'-[6-(1,4,7-trioxanonyl)-1-isoindolinyl)]2,2-stilbenedisulfonate; disodium 4,4'-(7-methoxymethyl-1-isoindolinyl)2,2-stilbenedisulfonate; disodium 4,4'-(6-phenyl-1-isoindolinyl) 2,2-stilbenedisulfonate; disodium 4,4'-(6-naphthyl-1-isoindolinyl)2,2-stilbenedisulfonate; disodium 4,4'-(6-methylsulfonyl-1-isoindolinyl)2,2-stilbenedisulfonate; disodium 4,4'-(7-cyano-1-isoindolinyl)2,2-stilbenedisulfonate; and disodium 4,4'-[7-(1,2,3-trihydroxypropyl)-1-isoindolinyl)]2,2-stilbenedisulfonate; disodium 4-isoindolinyl-4'-ethoxy-2,2'-stilbenedisulfonate; disodium 4-isoindolinyl-4'-methoxy-2,2-stilbenedisulfonate; disodium 4-isoindolinyl-4'-ethoxy-2,2'-stilbenedisulfonamide; disodium 4-isoindolinyl-4'-methyl-2,2'-stilbenedisulfonamide; 4,4'-bis(4-phenyl-2H-1,2,3-triazol-2-yl)-2,2'-stilbenedisulfonic acid and mixture thereof. See also U.S. Pat. Nos. 3,646,015, 3,346,502 and 3,393,153 for further examples of brighteners useful herein.

Indeed one of the functionally equivalent derivative salts of 4,4'-bis(4-phenyl-2H-1,2,3-triazol-2-yl)-2,2'-stilbenedisulfonic acid, namely its sodium salt is available from Mobay Chemical Corporation, a subsidiary of Bayer AG under the name Phorwite® CAN. The amine salt is available from Molay under the name Phorwite® CL solution. The potassium salt is available under the name Phorwite® BHC 766.

Other specific examples of optical brighteners useful in the present invention are those having the structural formula:

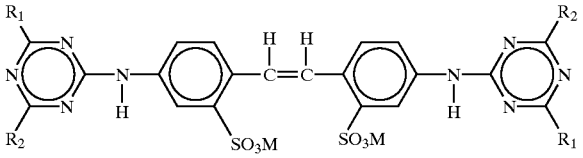

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Other substituted stilbene 2,2'-disulfonic acid derivatives also include 4-4-bis(2-2' styryl sulfonate)biphenyl, commercially available from Ciba-Geigy under the trade name Brightener 49® or other hydrophilic brighteners like for example Brightener 3® or Brightener 47®, also commercially available from Ciba-Geigy.

Further specific examples of brighteners useful in the present invention include the polycyclic oxazole derivatives such as benzo-oxazole derivatives, or mixtures thereof and particularly preferred herein the benzo-oxazole derivatives. An example of such a brightener is benzoxazole,2,2'-(thiophenaldyl)bis having the following formula C18H10N202S, commercially available from Ciba-Geigy under the trade name Tinopal SOP®. This brightener is almost insoluble in water, i.e. it has a solubility being lower than 1 gram per liter. Another example of such a brightener is bis(sulfobenzofuranyl)biphenyl, commercially available from Ciba-Geigy under the trade name Tinopal PLC®.

Typically the compositions according to the present invention comprise up to 1.0% by weight of the total composition of a brightener or a mixture thereof, preferably from 0.005% to 0.5%, more preferably from 0.005% to 0.3% and most preferably from 0.008% to 0.1%.

Builder

A further optional ingredient of the present composition is a builder. Highly preferred builder compounds for use in the present invention are water-soluble phosphate builders. Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerisation ranges from 6 to 21, and salts of phytic acid.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from 6 to 21, and salts of phytic acid.

Process of Bleaching Surfaces

In the present invention, the bleaching composition can be used to treat surfaces. By "surfaces", it is meant herein any inanimate surface. These inanimate surfaces include, but are not limited to, hard-surfaces typically found in houses like kitchens, bathrooms, or in car interiors, e.g., tiles, walls, floors, chrome, glass, smooth vinyl, any plastic, plastified wood, table top, sinks, cooker tops, dishes, sanitary fittings such as sinks, showers, shower curtains, wash basins, WCs and the like, as well as fabrics including clothes, curtains, drapes, bed linens, bath linens, table cloths, sleeping bags, tents, upholstered furniture and the like, and carpets. Inanimate surfaces also include household appliances including, but not limited to, refrigerators, freezers, washing machines, automatic dryers, ovens, microwave ovens, dishwashers and so on.

By "treating a surface", it is meant herein bleaching and/or disinfecting said surfaces as the compositions of the present invention comprise a hypohalite bleach and cleaning, i.e. removing various types of stains from the surfaces.

Thus, the present invention also encompasses a process of treating (e.g. bleaching) a fabric, as the inanimate surface. In such a process a fabric is contacted with a composition according to the present.

This can be done either in a so-called "pretreatment mode", where a liquid bleaching composition, as defined herein, is applied neat onto said fabrics before the fabrics are rinsed, or washed then rinsed, or in a "soaking mode" where a liquid bleaching composition, as defined herein, is first diluted in an aqueous bath and the fabrics are immersed and soaked in the bath, before they are rinsed, or in a "through the wash mode", where a liquid bleaching composition, as defined herein, is added on top of a wash liquor formed by dissolution or dispersion of a typical laundry detergent. It is also essential in both cases, that the fabrics be rinsed after they have been contacted with said composition, before said composition has completely dried off.

The processes of treating surfaces fabrics according to the present invention, especially fabrics, delivers effective whiteness performance and/or effective stain removal performance upon ageing of the compositions.

The compositions according to the present invention are preferably contacted to fabrics in a liquid form. Indeed, by "in a liquid form", it is meant herein the liquid compositions according to the present invention per se in neat or diluted form.

The compositions according to the present invention are typically used in diluted form in a laundry operation. By "in diluted form", it is meant herein that the compositions for the bleaching of fabrics according to the present invention may be diluted by the user, preferably with water. Such dilution may occur for instance in hand laundry applications as well as by other means such as in a washing machine. Said compositions can be diluted up to 500 times, preferably from 5 to 200 times and more preferably from 10 to 80 times.

More specifically, the process of bleaching fabrics according to the present invention comprises the steps of first contacting said fabrics with a bleaching composition according to the present invention, in its diluted form, then allowing said fabrics to remain in contact with said composition, for a period of time sufficient to bleach said fabrics, typically 1 to 60 minutes, preferably 5 to 30 minutes, then rinsing said fabrics with water. If said fabrics are to be washed, i.e., with a conventional composition comprising at least one surface active agent, said washing may be conducted together with the bleaching of said fabrics by contacting said fabrics at the same time with a bleaching composition according to the present invention and said detergent composition, or said washing may be conducted before or after that said fabrics have been bleached. Accordingly, said process according to the present invention allows to bleach fabrics and optionally to wash fabrics with a detergent composition comprising at least one surface active agent before the step of contacting said fabrics with said bleaching composition and/or in the step where said fabrics are contacted with said bleaching composition and/or after the step where said fabrics are contacted with the bleaching composition and before the rinsing step and/or after the rinsing step.

In another embodiment of the present invention the process of bleaching fabrics comprises the step of contacting fabrics with a liquid bleaching composition according to the present invention, in its neat form, of allowing said fabrics to remain in contact with said bleaching composition for a period of time sufficient to bleach said fabrics, typically 5 seconds to 30 minutes, preferably 1 minute to 10 minutes and then rinsing said fabrics with water. If said fabrics are to be washed, i.e., with a conventional composition comprising at least one surface active agent, said washing may be conducted before or after said fabrics have been bleached. In the embodiment of the present invention wherein the fabric is contacted with a bleaching composition of the present invention in its neat form, it is preferred that the level of hypohalite bleach, is from 0.01% to 5%, preferably from 0.1% to 3.5%, more preferably from 0.2% to 2% and most preferably from 0.2% to 1%. Advantageously, the present invention provides liquid hypohalite bleach-containing compositions that may be applied neat onto a fabric to bleach, despite a standing prejudice against using hypochlorite-containing compositions neat on fabrics.

It is preferred to perform the bleaching process herein before said fabrics are washed. Indeed, it has been observed that bleaching said fabrics with the compositions according to the present invention (diluted and/or neat bleaching processes) prior to washing them with a detergent composition provides superior whiteness and stain removal with less energy and detergent than if said fabrics are washed first, then bleached.

Alternatively instead of following the neat bleaching process as described herein above (pretreater application) by a rinsing step with water and/or a conventional washing step with a liquid or powder conventional detergent, the bleaching pre-treatment operation may also be followed by the diluted bleaching process as described herein before either in bucket (hand operation) or in a washing machine.

In another embodiment the present invention also encompasses a process of treating a hard-surface, as the inanimate surface. In such a process a composition, as defined herein, is contacted with the hard-surfaces to be treated. Thus, the present invention also encompasses a process of treating a hard-surface with a composition, as defined herein, wherein said process comprises the step of applying said composition to said hard-surface, preferably only soiled portions thereof, and optionally rinsing said hard-surface.

In the process of treating hard-surfaces according to the present invention the composition, as defined herein, may be applied to the surface to be treated in its neat form or in its diluted form typically up to 200 times their weight of water, preferably into 80 to 2 times their weight of water, and more preferably 60 to 2 times.

When used as hard surfaces bleaching/disinfecting compositions the compositions of the present invention are easy to rinse and provide good shine characteristics on the treated surfaces.

By "hard-surfaces", it is understood any hard-surfaces as mentioned herein before as well as dishes.

EXAMPLES

The invention is illustrated in the following non-limiting examples, in which all percentages are on a weight basis unless otherwise stated.

Example 1

10 g of Ultramarine Blue FRX from Hallyday pigments were mixed with 150 g of a sodium silicate solution (14% silicate) so to have a weight ratio SiO2/Ultramarine blue of 2/1. We will call this "premix 1".

With this premix 1 the following formulation are made:

| | |
|---|---|
| Sodium Hypochlorite | 5% |
| Sodium carbonate | 2% |
| Sodium Hydroxide | 1% |
| C16 Betaine | 0.3% |
| Sodium Toluene sulfonate | 0.5% |
| Premix 1 | 0.16% |

Example 2a

In example 2a and 2b the components of the composition are mixed in the given quantities. The pigments Ultramarine 54 and Ultramarine 17 are silica coated.

| | |
|---|---|
| Sodium Hypochlorite | 5% |
| Sodium carbonate | 2% |
| Sodium Hydroxide | 1% |
| C16 Amine oxide | 0.3% |
| Sodium Toluene sulfonate | 1% |
| Ultramarine Blue 54 | 0.02% |

Example 2b

| | |
|---|---|
| Sodium Hypochlorite | 5% |
| Sodium carbonate | 2% |
| Sodium Hydroxide | 1% |
| C16 Betaine | 0.3% |
| Sodium Toluene sulfonate | 1% |
| Ultramarine Blue 17 | 0.015% |

Example 3

The components of the composition are mixed in the given quantities.

| | |
|---|---|
| Sodium Hypochlorite | 5% |
| Sodium carbonate | 2% |

-continued

| | |
|---|---|
| Sodium Hydroxide | 1% |
| C16 Amineoxide | 0.3% |
| Sodium Toluene sulfonate | 1% |
| Ultramarine Blue FRX | 0.015% |
| Sodium silicate (as SiO2) | 0.05% |

What is claimed is:

1. A process of chemically stabilising an insoluble pigment selected from the Ultramarine class of pigments to the presence of hypohalite, said process comprising the step of combining said insoluble pigment with a silica salt, wherein said pigment is dispersed in a solution comprising silica salt to form a premix and said premix is combined with a composition comprising a hypohalite.

2. The process of claim 1 wherein said pigment is an Ultramarine blue pigment.

3. The process of claim 1 wherein said hypohalite comprises hypochlorite bleach.

4. The process of claim 1 wherein the weight ratio of silica salt to pigment is at least 0.5:1.

5. The process of claim 4 wherein the step of combining said pigment and silica salt comprises the step of coating said pigment with said silica or a salt thereof.

6. The process of claim 1 wherein the composition comprising a hypohalite comprises a thickening system.

7. The process of claim 6 wherein said thickening system is a system selected from systems comprising an amphoteric or zwitterionic surfactant, an alkyl or alkoxylated sulfate or mixture thereof.

8. The process of claim 7 wherein said thickening system comprises a surfactant selected from the group consisting of $C_{12}$–$C_{18}$ amine oxide, $C_{12}$–$C_{18}$ betaine, $C_{12}$–$C_{18}$ sulphobetaine and mixtures thereof; and a sulphonate counterion.

9. The process of claim 8 wherein said thickening system comprises a surfactant selected from the group consisting of $C_{16}$ amine oxide, $C_{16}$ betaine, and mixtures thereof; and a sulphonate counterion selected from the group consisting of sodium cumene sulphonate, sodium xylene sulphonate, sodium toluene sulphonate and mixtures thereof.

10. A bleaching composition produced according to the process of claim 7.

* * * * *